United States Patent [19]

Johanson

[11] Patent Number: 5,031,887

[45] Date of Patent: Jul. 16, 1991

[54] LOCKING SYSTEM FOR PRECISION VISE

[76] Inventor: Lars Johanson, 72 Hillsdale Rd., Cedar Grove, N.J. 07009

[21] Appl. No.: 555,603

[22] Filed: Jul. 23, 1990

[51] Int. Cl.[5] ..... B25B 1/12

[52] U.S. Cl. ..... 269/137

[58] Field of Search ..... 269/137, 165, 189, 194, 269/195, 207, 211, 212, 213, 215, 240

[56] References Cited

U.S. PATENT DOCUMENTS

| | | | |
|---|---|---|---|
| 540,413 | 6/1895 | Vanderbeek | 269/137 |
| 4,713,515 | 12/1987 | Choi et al. | 269/137 |
| 4,736,935 | 4/1988 | Vasapolli | 269/137 |

*Primary Examiner*—Robert C. Watson

*Attorney, Agent, or Firm*—Fleit, Jacobson, Cohn, Price, Holman & Stern

[57] ABSTRACT

The locking system for a precision vise includes a slotted base with downwardly facing serrations engaged by a locking block having upwardly facing serrations with the locking block being connected to the lower end of a bolt oriented generally at a 45° angle and extending upwardly through the slot and a passageway in the movable jaw to clamp the movable jaw in adjusted position. The bolt includes a threaded upper end with a nut thereon and a flange or shoulder intermediate the ends engaged by light spring which also engages a downwardly facing surface on the movable jaw to move the locking block downwardly in order to assure that the serrations on the locking block will not engage the serrations on the base when the nut on the locking bolt is rotated to release the movable jaw. The bottom surface of the base is recessed with the serrations being in the downwardly facing upper surface of the recess and a slotted retaining plate is provided flush with the bottom surface of the base to retain the locking block when the movable jaw is released and being adjusted.

5 Claims, 1 Drawing Sheet

LOCKING SYSTEM FOR PRECISION VISE

BACKGROUND OF THE INVENTION

1. Field of the Invention

The present invention relates to a precision vise used for holding a workpiece while various work operations are being performed such as grinding, jig grinding, boring and other similar work operations in which the vise includes a base, a stationary jaw mounted thereon and a movable jaw secured in adjusted position by a unique locking system for the movable jaw. The locking system for a precision vise includes a slotted base with downwardly facing serrations engaged by a locking block having upwardly facing serrations with the locking block being connected to the lower end of a bolt oriented generally at a 45° angle and extending upwardly through the slot and a passageway in the movable jaw to clamp the movable jaw in adjusted position. The bolt includes a threaded upper end with a nut thereon and a flange or shoulder intermediate the ends engaged by light spring which also engages a downwardly facing surface on the movable jaw to move the locking block downwardly in order to assure that the serrations on the locking block will not engage the serrations on the base when the nut on the locking bolt is rotated to release the movable jaw. The bottom surface of the base is recessed with the serrations being in the downwardly facing upper surface of the recess and a slotted retaining plate is provided flush with the bottom surface of the base to retain the locking block when the movable jaw is released and being adjusted.

2. Description of the Prior Art

Various types of vises for holding work pieces, tools and the like are well known as exemplified by the following U.S. Pat. Nos.:

2,760,535
2,992,665
3,506,253
4,713,515
4,736,935

Several of the above patents include a vise having a stationary jaw and a movable jaw with the stationary jaw including a laterally elongated base slidably receiving the stationary jaw with a clamp bolt extending through the movable jaw in an inclined manner and through a slot in the base to engage a locking block with the locking block and base including serrations by which the movable jaw can be locked in place. However, the above listed prior patents o not disclose the specific structure of the movable jaw, locking bolt and locking block of the present invention in which the base includes a retaining plate for the locking block and the locking bolt includes a light spring biasing the bolt and locking block towards a release position of the locking block to enable release of the locking block and movable jaw with approximately one turn of a nut on the locking bolt.

SUMMARY OF THE INVENTION

An object of the present invention is to provide a locking system for a precision vise including a stationary jaw mounted fixedly on a laterally extending base and a movable jaw adjustably mounted on the base for movement toward and away from the stationary jaw with the locking system utilizing a 45° principle for exerting a hold-down force on the movable jaw and to provide a final clamping force to the movable jaw.

Another object of the invention is to provide a locking system in accordance with the preceding object in which the laterally extending base includes a bottom recess and a longitudinal slot communicating with the bottom recess combined with a locking block in the recess and a clamp bolt extending upwardly from the locking block, through the slot and through an inclined passageway in the movable jaw with the locking block and downwardly facing surface in the recess including interengaging serrations to enable the movable jaw to be moved toward and away from the stationary jaw when the locking block is released and to lock the movable jaw in position and move it to a final clamping position when the locking block serrations are moved upwardly toward the serrations in the recess by the inclined bolt.

A further object of the invention is to provide a locking system in accordance with the preceding objects in which the locking bolt includes a flange provided with a light spring engaging the upper surface thereof with the other end of the light spring engaging a recess in the bottom of the movable jaw to move the locking block away from the serrated surface of the recess when the bolt in released by rotating a threaded nut at the upper end thereof.

Still another object of the invention is to provide a locking system in accordance with the preceding objects in which the recess in the bottom of the base includes a retaining plate for retaining the locking block within the recess with the serrations on the locking block slightly spaced from the serrations on the recess when the locking bolt is released.

A still further object of the present invention is to provide a locking block for a precision vise which is simple in construction, dependable and long lasting, effective for exerting a hold-down force and clamping force on the movable jaw and requiring approximately one turn of a clamping nut on the locking bolt to lock and release the movable jaw.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
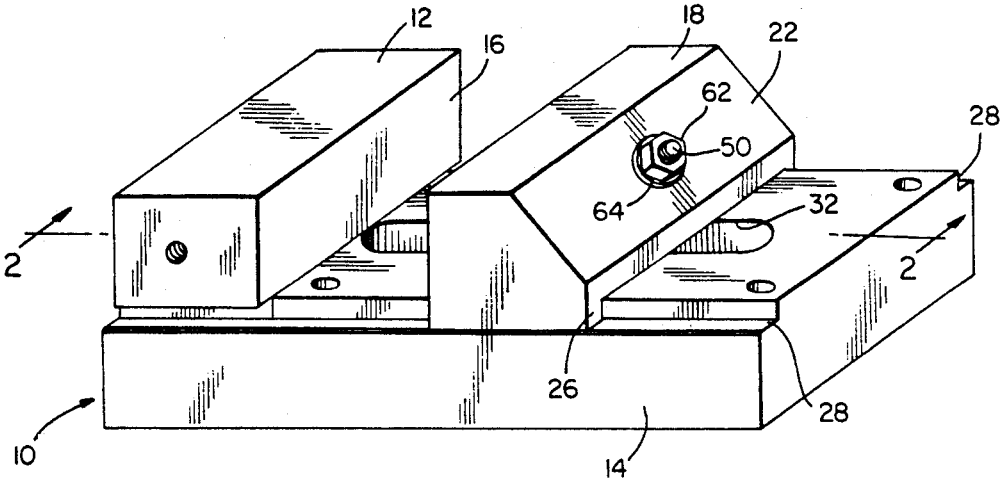
FIG. 1 is a perspective view of a precision vise illustrating the locking system of the present invention incorporated therein.

A precision vise incorporating the locking system of the present invention is illustrated in the drawings and generally designated by reference numeral 10 and includes a stationary jaw 12 rigidly affixed or integral with an elongated base 14 which extends laterally beyond the gripping face 16 of the stationary jaw 12. A movable jaw 18 having a gripping face 20 in opposed parallel relation to the face 16 of the stationary jaw 12 is slidably adjustably mounted on the base 14 for movement toward and away from the stationary jaw 12 for securely clamping a work piece, tool or other device (not shown) between the jaws 12 and 18. The movable jaw 18 includes an inclined surface 22 remote from the gripping face 20 and the bottom surface of the movable jaw 18 includes a recess 24 defined by a pair of downwardly extending edge flanges 26 which are received in a pair of longitudinal recesses 28 at the upper corners of the base 14 as illustrated in FIGS. 1 and 3 with these surfaces being accurate to provide precision guided movement of the movable jaw 18 toward and away from the stationary jaw 12.

Figure 2:
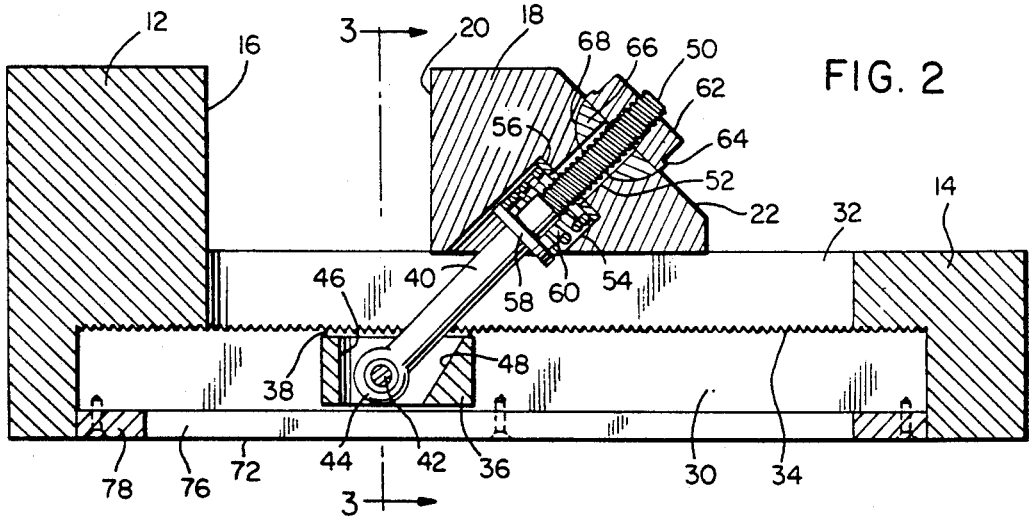
FIG. 2 is a longitudinal, sectional view taken substantially upon a plane passing along section line 2—2 on FIG. 1 illustrating specific structural details of the locking system.
Figure 3:
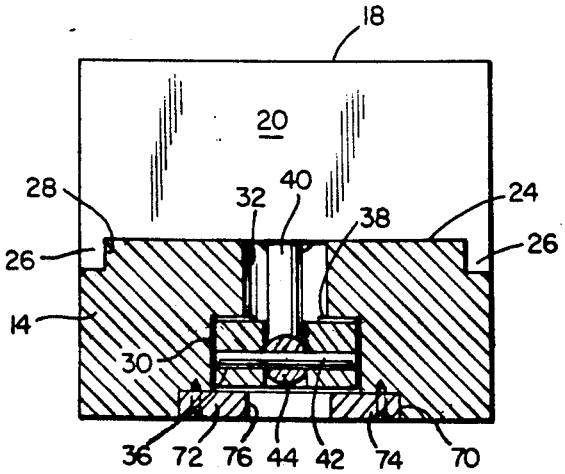
FIG. 3 is a transverse, sectional view taken substantially upon a plane passing along section line 3—3 on FIG. 1 illustrating further structural details of the locking system.

The bottom surface of the base 14 includes a longitudinally extending, downwardly opening recess 30 which extends transversely of the base 14 as illustrated in FIGS. 2 and 3. The base 14 also includes a longitudinally extending slot 32 which extends from the upper surface of the base 14 to the recess 30 with the slot 32 extending from the face 16 of the stationary jaw to a point adjacent the opposite end of the recess 30 which extends beyond each end of the slot 32 as illustrated in FIG. 2. Both the slot and recess are centered along the longitudinal center line of the base as illustrated in FIG. 3. The recess 30 includes transverse serrations 34 on the downwardly facing surface thereof outwardly of the slot 32 as illustrated in FIGS. 2 and 3 with the serrations 34 having a 60° pitch.

A locking block 36 is positioned in the recess 30 and includes transverse serrations 38 on the upper surface thereof for engagement with the serrations 34 along the upper surface of the recess 30. The locking block 36 has a locking bolt 40 connected thereto by a transverse pivot pin 42 which extends through an eye 44 on the lower end of the bolt 40. The locking block 36 includes a vertical opening 46 receiving the lower end of the bolt with the side of the opening 46 remote from the stationary jaw 12 being inclined as indicated by reference numeral 48 to enable the bolt 40 to assume a 45° angle in relation to the locking block 36 and the upper surface of the base 14. The bolt 40 extends upwardly and in diverging relation to the gripping faces 16 and 20 of the jaws 12 and 18 with the upper end of the bolt 40 being threaded at 50 with the threaded end extending through a passageway 52 in the movable jaw 18 which intersects with surface 22 and is generally at a 45° angle to the gripping face 20. The passageway 22 includes an enlarged recess 54 at its lower end defining a shoulder 56 larger than the passageway 52 and extending radially therefrom. The bolt 40 also includes a flange 58 rigid therewith in opposed spaced relation to the shoulder 56. A light coil compression spring 60 is positioned between the shoulder 56 and the flange 58 to spring bias the bolt 40 longitudinally downwardly to release the locking block serrations 38 from the recess serrations 34 when the bolt 40 moves downwardly in relation to the movable jaw.

A retaining and clamping nut 62 is provided on the upper end of the threaded end 50 of the bolt with the nut 62 being polygonal in configuration to receive a wrench or the like and the inner end of the nut 62 includes a cylindrical flange 64 engaging the upper surface of a semi-cylindrical adaptor 66 which can rock or pivot in a correspondingly shaped recess 68 formed in the inclined surface 22 as illustrated in FIG. 2. The degree of movement of the adaptor 66 will be quite small inasmuch as the passageway 52 is only slightly larger than the threaded end 50 of the bolt 40 so that the bolt 40 moves longitudinally when the nut 62 is tightened or released by rotation. The spring 60 biases the bolt 40 downwardly to release the locking block 36 when the nut 62 is rotated in a counterclockwise direction approximately one turn which is sufficient to release the serrations 38 from the serrations 34 thus enabling the movable jaw 18 to be moved toward and away from the stationary jaw 12. When the movable jaw has been moved to a position to engage a workpiece positioned between the jaws, the nut 62 will be tightened and the engagement of the serrations 38 with the serrations 34 enables a downward and longitudinally inward force to be exerted on the movable jaw 18 thus holding the jaw downwardly against the base in precision position and maintaining the parallelism between the gripping faces 16 and 20 and at the same time providing a clamping force for clamping the workpiece between the jaws due to the inclined relationship of the interengaging surfaces of the serrations 38 and 34.

The bottom surface of the base 14 includes a shallow and transversely wider recess 70 as compared to the recess 30 as illustrated in FIG. 3 with the recess 70 having the same longitudinal extent as the recess 30. A retainer plate 72 is positioned in the recess 70 with the bottom surface of the retainer plate 72 being substantially flush with the bottom surface of the base and the retainer plate 72 is secured in place by countersunk screw threaded fasteners 74 extending upwardly into the base 14. The retaining plate includes a longitudinal slot 76 therein which extends almost the full length of the plate 72 with the plate 72 including end portions 78 maintaining the rigidity of the plate. As illustrated, the slot 76 is narrower than the locking block 36 and supports the locking block 36 when it is lowered when the locking bolt 40 is released by rotating the nut 62 thus retaining the locking block in adjacent but spaced relation to the serrations 34 to enable the locking block and thus the bolt 40 and movable jaw 18 to be moved longitudinally of the base without engagement of the serrations 38 with the serrations 34. As illustrated in FIG. 3, when the locking block is in engaged or locked position, there is a space between the bottom surface of the locking block and the upper surface of the retainer plate which enables the locking block to drop downwardly a limited distance. This retains the locking block accurately in relation to the serrations 34 and enables only approximately one turn of the nut to fully release and fully lock the locking block in relation to the base.

The 45° principle of the locking bolt combined with the structure of the locking block, the interengagement of the serrations and the construction of the bolt including the flange, spring and nut all cooperate to provide a quick and simple adjustment of the movable jaw and also provides an effective hold-down and final clamping movement of the movable jaw 18 in relation to the stationary jaw 12.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A locking system for a vise having a stationary jaw, a laterally extending base rigid with the stationary jaw, a movable jaw, means mounting the movable jaw on the base for movement toward and away from the stationary jaw, said locking system comprising a longitudinal slot in said base, a longitudinal recess in a bottom surface of the base with the slot communicating with the recess, a locking block disposed in said recess, said locking block including serrations on an upper surface thereof and said recess including downwardly facing serrations on a downwardly facing surface extending transversely of the slot and extending laterally from the edges of the slot, a locking bolt connected to the locking block and extending upwardly through the slot in inclined diverging relation to the stationary jaw, said movable jaw including an inclined passageway therethrough receiving the locking bolt, said locking bolt including a threaded end extending above the movable jaw and provided with a nut thereon by which the locking block can be moved upwardly to engage the serrations thereon with the serrations in the recess for locking the movable jaw in longitudinally adjusted position on the base and moving the movable jaw toward the stationary jaw, said bolt including a peripheral flange positioned above the base and received in a recess in a bottom surface of the movable jaw with the recess and passageway being in communication, a coil compression spring positioned between the flange and an inner end of the recess to bias the bolt and locking block downwardly in relation to the base when the nut on the locking bolt is rotated to release the locking bolt.

2. The structure as defined in claim 1 wherein said locking bolt is pivotally connected to the locking block by a transverse pin, said bolt having an end eye receiving said transverse pin.

3. The structure as defined in claim 2 wherein said movable jaw includes an inclined surface in remote relation to the stationary jaw, said passageway communicating with the inclined surface and terminating in a semispherical recess, said bolt including a semispherical adaptor positioned in the recess and engaged by the nut to enable limited pivotal movement of the bolt in relation to the movable jaw, said passageway being only slightly larger in diameter than the portion of the bolt extending therethrough to maintain the bolt in an inclined relationship to the movable jaw.

4. The structure as defined in claim 2 wherein said recess in the base is provided with a retainer plate in a lower end thereof with the retainer plate being flush with the bottom surface of the base, said retainer plate being spaced from the locking block a distance sufficient to enable the locking block to move downwardly to disengage the serrations on the locking block from the serrations on the recess to enable adjustment of the movable jaw and retain the locking plate in closely spaced relation to the serrations on the recess thereby enabling the locking bolt to be moved between locking and released positions by approximately a single turn of the clamping nut.

5. A locking system for a vise having a stationary jaw, a laterally extending base rigid with the stationary jaw, a movable jaw, means mounting the movable jaw on the base for movement toward and away from the stationary jaw, said locking system comprising a longitudinal slot in said base, a longitudinal recess in a bottom surface of the base with the slot communicating with the recess, a locking block disposed in said recess, said locking block including serrations on an upper surface thereof and said recess including downwardly facing serrations on a downwardly facing surface extending transversely of the slot and extending laterally from the edges of the slot, a locking bolt connected to the locking block and extending upwardly through the slot in inclined diverging relation to the stationary jaw, said movable jaw including an inclined passageway therethrough receiving the locking bolt, said locking bolt including a threaded end extending above the movable jaw and provided with a nut thereon by which the locking block can be moved upwardly to engage the serrations thereon with the serrations in the recess for locking the movable jaw in longitudinally adjusted position on the base and moving the movable jaw toward the stationary jaw, said recess being provided with a retainer plate in a lower end thereof with the retainer plate being flush with the bottom surface of the base, said retainer plate being spaced from the locking block a distance sufficient to enable the locking block to move downwardly to disengage the serrations on the locking block from the serrations on the recess to enable adjustment of the movable jaw and retain the locking plate in closely spaced relation to the serrations on the recess thereby enabling the locking bolt to be moved between locking and released positions by approximately a single turn of the clamping nut, said bolt including a peripheral flange positioned above the base and received in a recess in a bottom surface of the movable jaw with the recess and passageway being in communication, a coil compression spring positioned between the flange and an inner end of the recess to bias the bolt and locking block downwardly in relation to the base when the nut on the locking bolt is rotated to release the locking bolt.

* * * * *